US011788444B2

(12) United States Patent
Hajek et al.

(10) Patent No.: US 11,788,444 B2
(45) Date of Patent: Oct. 17, 2023

(54) OIL PAN FOR MOTOR VEHICLES HAVING ADDITIONAL CONNECTION POINTS

(71) Applicant: Bayerische Motoren Werke Aktiengesellschaft, Munich (DE)

(72) Inventors: Jan Hajek, Kirchseeon (DE); Frank Horn, Strasslach (DE); Maximilian Rosenberger, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/633,621

(22) PCT Filed: Sep. 14, 2020

(86) PCT No.: PCT/EP2020/075602
§ 371 (c)(1),
(2) Date: Feb. 8, 2022

(87) PCT Pub. No.: WO2021/073814
PCT Pub. Date: Apr. 22, 2021

(65) Prior Publication Data

US 2022/0316369 A1 Oct. 6, 2022

(30) Foreign Application Priority Data

Oct. 16, 2019 (DE) ..... 10 2019 127 874.0

(51) Int. Cl.
*F01M 11/00* (2006.01)

(52) U.S. Cl.
CPC . *F01M 11/0004* (2013.01); *F01M 2011/0087* (2013.01)

(58) Field of Classification Search
CPC ..... F01M 11/0004; F01M 2011/0087; F01N 13/01805; F01N 13/10; F01N 13/002
See application file for complete search history.

(56) References Cited

U.S. PATENT DOCUMENTS 7,204,224 B2 * 4/2007 Hazelton ..... F01M 11/0004 123/196 R
2010/0212623 A1 * 8/2010 Jessberger ..... F01M 11/0004 123/196 R (Continued)

FOREIGN PATENT DOCUMENTS

AT 378 408 B 8/1985
DE 35 20 176 C1 1/1987

(Continued)

OTHER PUBLICATIONS

International Search Report (PCT/ISA/210) issued in PCT Application No. PCT/EP2020/075602 dated Nov. 26, 2020 with English translation (five (5) pages).

(Continued)

*Primary Examiner* — Syed O Hasan
(74) *Attorney, Agent, or Firm* — Crowell & Moring LLP

(57) ABSTRACT

A two-part oil pan for an internal combustion engine has a box portion and a pan portion. The pan portion forms a floor of the oil pan and the box portion forms a pan wall of the oil pan. On a peripheral edge having a peripheral first sealing surface on the pan portion and a peripheral second sealing surface on the box portion, the box portion and the pan portion are interconnected in a sealed manner by means of first connection means. The pan portion and the box portion additionally are interconnected by at least one second connection means which is arranged within the edge and additionally at a distance from said edge.

9 Claims, 7 Drawing Sheets

(56) References Cited

U.S. PATENT DOCUMENTS

| | | | | |
|---|---|---|---|---|
| 2015/0226101 | A1* | 8/2015 | Nishimura | F01N 3/103<br>123/456 |
| 2015/0240698 | A1* | 8/2015 | Nishimura | F01N 13/1805<br>60/278 |

FOREIGN PATENT DOCUMENTS

| | | | |
|---|---|---|---|
| DE | 10 2006 003 664 | A1 | 8/2007 |
| DE | 10 2008 048 793 | A1 | 3/2010 |
| DE | 10 2013 204 157 | A1 | 9/2014 |

OTHER PUBLICATIONS

German-language Written Opinion (PCT/ISA/237) issued in PCT Application No. PCT/EP2020/075602 dated Nov. 26, 2020 (seven (7) pages).

German-language Office Action issued in German Application No. 10 2019 127 874.0 dated Jun. 18, 2020 (five (5) pages).

* cited by examiner

OIL PAN FOR MOTOR VEHICLES HAVING ADDITIONAL CONNECTION POINTS

BACKGROUND AND SUMMARY OF THE INVENTION

The present invention relates to a two-part oil pan for an internal combustion engine.

Oil pans are known in a wide variety of embodiments and are used for example in internal combustion engines or transmissions. They are used there to accommodate and store an oil quantity that is required for the lubrication of the internal combustion engine or of the transmission. For this purpose, the lubricating system generally comprises an oil pump that conveys the lubricating oil out of the oil pan in a lubricating circuit. After passing through the lubricating circuit, the circulating oil is then generally collected in the oil pan again. Here, the return action is normally effected by the gravitational force acting on the oil. For this reason, in the case of internal combustion engines, oil pans are generally arranged below a crankcase. Oil pans are furthermore often formed as a single-piece metal sheet or casting. Two-part oil pans, for example, are however also known.

DE 10 2006 003 664 A1 has disclosed, for example, an oil pan for motor vehicles with front-wheel drive or all-wheel drive, which oil pan has an upper part, which is formed as a casting and on which a transmission axle leadthrough is integrally formed, and a lower part, which is flange-mounted onto the upper part. Here, one longitudinal side of the upper part is equipped with bores for receiving screws by means of which a front-axle transmission can be fastened. The other longitudinal side of the upper part is equipped with bores for receiving screws by means of which an axle shaft bearing block can be fastened. The upper part is of box-like form and, over the major part of its underside, is open or is formed without a base. Here, in that region of the upper part which has no base, there are arranged struts which run in a transverse direction and which are connected to the side walls of the upper part.

In the variants known in the prior art, the acoustic characteristics of the oil pans still have room for improvement. In practice, it has for example been found that body-borne sound vibrations and/or airborne sound vibrations are radiated to the outside from an oil interior space, which is enclosed by the crankcase and the oil pan, predominantly via the oil pan. In particular, components which are installed in the oil pan and which in practice are fully or partially completely immersed in oil typically conduct body-borne sound via their connecting points into the oil pan, or the sound is transmitted via the oil that is situated between the component and the oil pan inner wall.

It is therefore an object of the present invention to provide an oil pan that has improved acoustic characteristics.

To achieve the above-stated object, an oil pan according to the features of the independent claim is provided. Advantageous refinements are specified in the dependent claims. It is pointed out that the features given in the patent claims may be combined with one another in any desired manner. The description, in particular in conjunction with the figures, explains the invention and specifies further advantageous refinements of the invention.

It is sought to describe a two-part oil pan for an internal combustion engine, wherein the oil pan has a box section and a pan section, wherein the pan section forms a base of the oil pan and the box section forms a pan wall of the oil pan, wherein the box section and the pan section are sealingly connected to one another by first connecting means at an encircling rim with an encircling first sealing surface on the pan section and an encircling second sealing surface on the box section, wherein the pan section and the box section are additionally connected to one another by at least one second connecting means which is arranged within the rim and furthermore with a spacing to said rim.

The two-part oil pan is configured for use on a crankcase of an internal combustion engine, wherein the oil pan has a pan section (situated at the bottom in the installed situation) with a base, and has a rim adjoining this (upwardly in the installed situation). The pan section has an opening which is aligned with a box section arranged thereabove and which has a first sealing surface, wherein the sealing surface is preferably arranged on a top side of the rim.

Furthermore, on a bottom side, the box section has a second sealing surface, wherein the first sealing surface of the pan section and the second sealing surface of the box section are of complementary form with respect to one another such that, in the assembled state, they sealingly enclose an oil interior space. In this context, "complementary" means in particular that the sealing surfaces have for example a shape, width, etc. such that, when they bear against one another, they prevent a passage of oil. The box section forms a pan wall which extends upward from the base of the oil pan.

Furthermore, first connecting means are provided for connecting the rim of the pan section to the box section and at least one additional second connecting means is provided for connecting the base of the pan section to the box section, wherein the second connecting means is arranged within the rim and furthermore with a spacing to said rim. Here, first connecting means are preferably arranged so as to be distributed along the rim, for example in the form of screw connections.

The expression "connecting means" will be used below to mean individual or multiple constituent parts of a respective connecting means. Accordingly, a connecting means may be composed of a screw, a threaded section in the box section, and a bore in the pan section. If, for example, only the bore and a screw are shown in a figure, these will nevertheless be referred to as first or second connecting means. The connecting means may also be referred to as a connecting element, connecting device or the like.

The expressions "top" and "bottom" relate to the vertical direction and are to be understood in the sense of vertically top and vertically bottom, wherein this relates in each case to the customary installed situation of the oil pan below an internal combustion engine in a motor vehicle. Correspondingly, the expression "laterally" is to be understood in the sense of horizontally laterally.

The base is to be understood to mean that section of the pan section which is arranged at the bottom and which downwardly closes off the oil pan in oil-tight fashion. Correspondingly, the rim is that section of the pan section which closes off the oil pan in oil-tight fashion laterally. The rim is adjoined by the box section, or the pan wall formed by the box section, of the oil pan, which box section likewise closes off the oil pan in oil-tight fashion.

In the case of known oil pans, it is provided that a connection between the oil pan and the crankcase is realized only at or via the lateral rims of the oil pan. The base of the oil pan is thus fixedly connected only at the rim, and in particular not in its center.

By contrast to this, it is now proposed for at least one second connecting means to be provided, and for this to be arranged with a spacing to the rim of the pan section such that the second connecting means preferably connects the base of the pan section directly to the box section. Advantageous stiffening of the pan section is thus achieved. In this context, an arrangement of the second connecting means "within the rim" means in particular that the rim surrounds an inner surface through which the second connecting means (or local projections, which form/receive these, of the base and/or box section) projects. The positioning with a spacing means in particular that (when viewing this inner surface enclosed by the rim), there is a gap, free space, etc. between the rim and the second connecting means, that is to say there is no direct or merging contact between the rim and the second connecting means.

The pan section is thus connected by way of its rim and the first connecting means and additionally by way of the base and the second connecting means to the box section. In this way, undesired vibrations of the base of the pan section, in particular in the center thereof, can be effectively avoided. Since the base of the pan section vibrates similarly to a diaphragm, the improvement in acoustic characteristics achieved by means of the present invention is all the greater the greater the spacing that is selected of the second connecting means to the rim of the pan section and the greater the number of second connecting means that are used. Here, the second connecting means fundamentally changes the natural frequency of the installed pan section such that said natural frequency is greatly increased. The increase in the natural frequency then has the effect that sonic vibrations radiated from the oil interior space are no longer emitted, or are emitted only to a considerably reduced degree, via the two-part oil pan into the surroundings. In addition to the overall increase of the natural frequency of the system, it is advantageously the case that central excitation points are broken up into specific frequency ranges. It is the aim for the vibration energy to be dissipated not at one location but across multiple locations in the system.

With a two-part oil pan, it is advantageously also possible for the oil volume enclosed by the oil pan to be easily varied by virtue of the height of the box section and thus also the height of the pan section being varied. Furthermore, the box section may be configured such that it also accommodates additional components, for example drive devices for a front-wheel drive or all-wheel drive system.

The oil pan is particularly preferred if the box section has at least one transverse strut which connects two mutually spaced-apart regions of the pan wall to one another, wherein the pan section and the box section are connected to one another at the transverse strut by the second connecting means.

For the connection of the pan section to the box section by the second connecting means, the box section may for example be stiffened by means of transverse struts which have so-called screw bosses in order to thereby produce a screw connection to the base of the pan section. Here, the transverse struts can contribute to the additional mechanical stiffening of the two-part oil pan and prevent twisting of the oil pan during driving operation.

In particular, first sealing means may furthermore be provided on the first sealing surface between the box section and the pan section. These first sealing means ensure that the encircling rim between the box section and the pan section is reliably sealed off.

In particular, additional second sealing means for sealing off the base may be provided at the second connecting means. Said second sealing means ensure that that the region of the base at which the second sealing means is arranged is also sealingly closed off, such that no oil can escape from the oil interior space.

In particular, it is also possible for the spacing between the second connecting means and the rim, measured in an orthogonal direction from an inner side of the rim, to be selected so as to be at least 20 mm [millimeters], preferably at least 100 mm. If a second connecting means is arranged with this minimum spacing or with a greater spacing to the rim, it is possible to achieve considerable increases in the natural frequency of the oil pan and/or of the wall section and/or of the base and thus also for the acoustic characteristics to be considerably improved such that the sound radiation is reduced. The spacing proposed here is preferably a minimum spacing to the closest section of the rim; in other words, this means that the spacing is preferably not smaller to any other section of the rim (when considering the internal cross section, or abovementioned inner surface, at the level of the rim).

In particular, the second connecting means may be arranged within a radius R about a center of area of the base of the pan section. Here, the center of area is the geometrical center of area of the base. In the case of particularly simple geometries, such as a circle or a square, the center of area lies exactly at the central point of the base. In practice, oil pans however often have much more complex geometries. In this case, it is possible to project the rim of the pan section onto a plane which is arranged orthogonally with respect to the rim, preferably horizontally, and to determine the center of area on the basis of the area enclosed by the projected rim. This plane is normally a horizontal plane, because the oil flows downward in a vertical direction from the crankcase back into the oil pan owing to gravitational force, and therefore the rims of the oil pan or of the pan sections extend substantially in a vertical direction.

It is ideally then the case that at least one second fastening means is situated in the region of this center of area, which can also be referred to as center. Alternatively, it is also possible for multiple second fastening means to be arranged in a region around the center of area if sufficient structural space is not available there. The center of area or the center is particularly expedient as a positioning aid for the second connecting means, because it is there that the greatest vibration amplitudes of the vibrating base are to be expected.

In particular, it is possible for internal combustion engines to be equipped with a described two-part oil pan. Such internal combustion engines then exhibit reduced emission of sound, because the release of sound emissions via the oil pan is considerably reduced. Aside from the use of the oil pan of such design on an internal combustion engine, such an oil pan may also be used in other circumstances. For example, it may be used on transmission units that have independent lubricating systems. In particular in the case of relatively large transmissions, such as are used for example in plant construction or in utility vehicles, separate two-part oil pans according to the invention can likewise contribute to a considerable improvement in acoustic characteristics.

In particular, it is possible for motor vehicles to be equipped with a described internal combustion engine, wherein such vehicles require no or only considerably reduced insulation measures in the region of the engine due to the reduced sound emissions. In this way, it is at the same time possible to realize cost savings and weight savings.

It is pointed out by way of precaution that the numerical terms used here ("first", "second", . . . ) serve primarily (only) for distinction between several similar objects, dimensions or processes, that is to say in particular do not imperatively specify any dependency and/or sequence of these objects, dimensions or processes in relation to one another. Should a dependency and/or sequence be necessary, this is explicitly stated here, or is obvious to a person skilled in the art when studying the specifically described embodiment.

The invention and the technical field will be discussed below on the basis of the appended figures. It is pointed out that it is not the intention for the invention to be restricted by the specified exemplary embodiments. In particular, unless explicitly stated otherwise, it is also possible for partial aspects of the substantive matter discussed in the figures to be extracted and combined with other constituent parts and insights from the present description. In particular, it is pointed out that the figures and in particular the illustrated proportions are merely schematic.

DETAILED DESCRIPTION OF THE DRAWINGS

Figure 1:
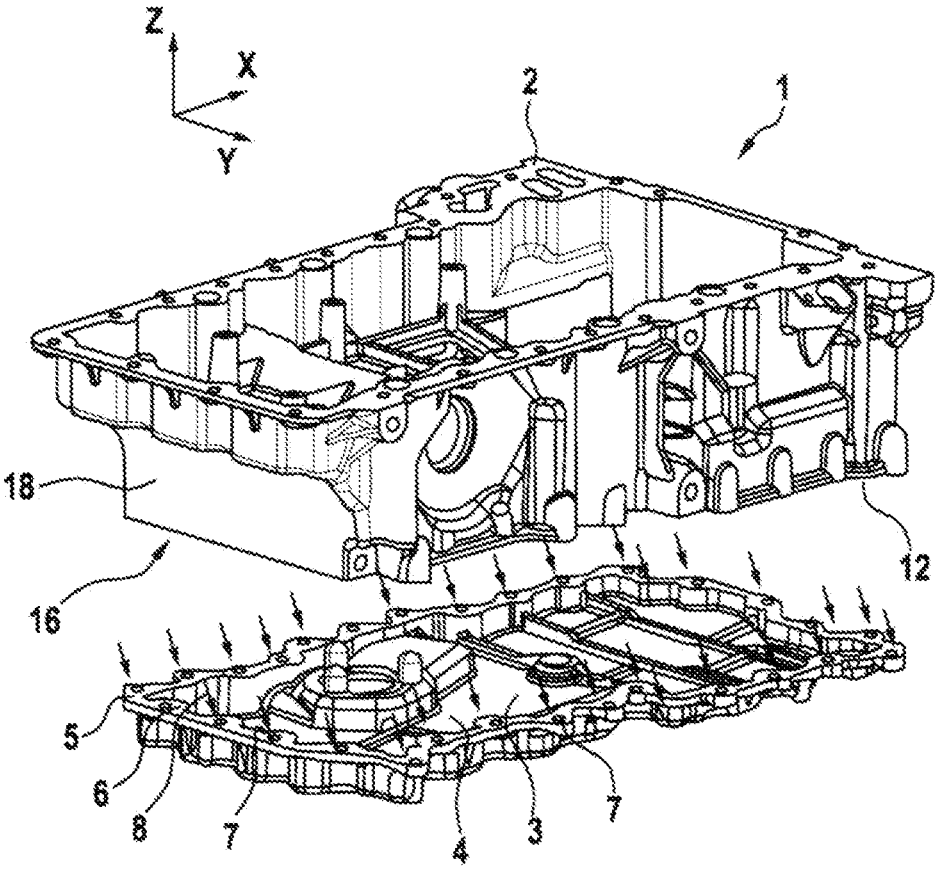
FIG. 1 Prior Art
FIG. 1 is an oblique view of a two-part oil pan according to the prior art.

FIG. 1 illustrates a two-part oil pan 1 according to the prior art in an oblique view. The oil pan is composed of an upper box section 2 and a lower pan section 3. The pan section 3 has a base 4, a rim 5 laterally surrounding the base 4, and a first sealing surface 6. The box section 2 forms an encircling pan wall 18 and a second sealing surface 12. Provided in the region of the sealing surface 6 is a multiplicity of bores 7 through which the pan section 3 can be connected by first connecting means 8, which may be in the form of screws, to the box section 2. The base 4 (floor) of the pan section 3 extends substantially in a horizontal plane that is oriented parallel to the X-Y plane of the indicated coordinate system.

Figure 2:
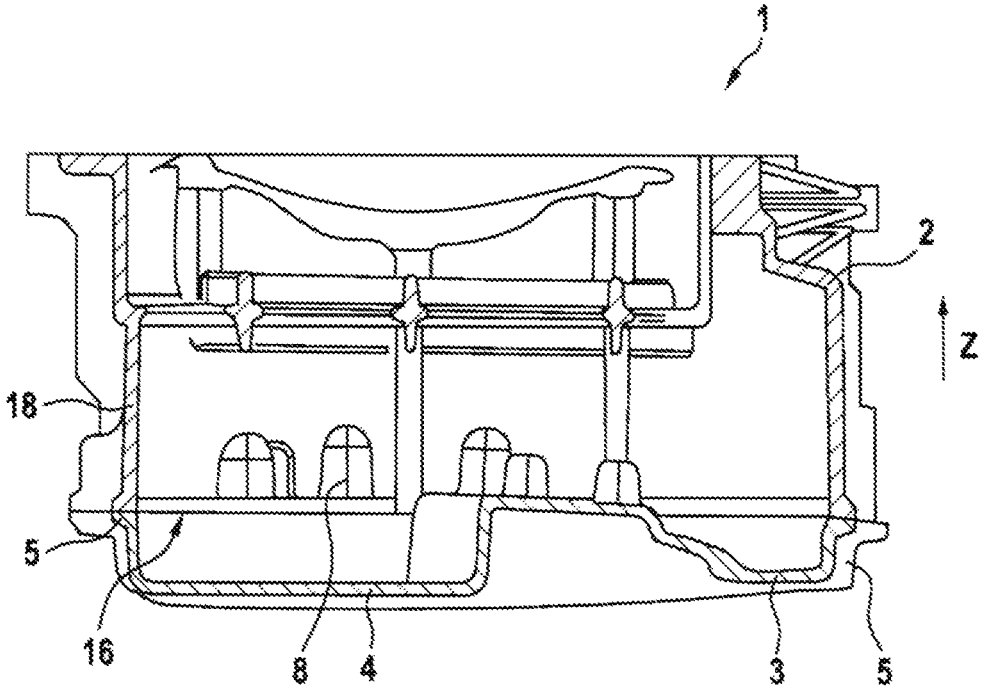
FIG. 2 Prior Art
FIG. 2 is a vertical sectional view through the oil pan as per FIG. 1.

FIG. 2 shows a vertical sectional view of the two-part oil pan 1 as per FIG. 1 with the box section 2 situated at the top, which box section has the pan wall 18 and has an opening 16 which is closed by the pan section 3 situated at the bottom. The base 4 of the pan section 3 is oriented substantially horizontally, and the rim 5 thereof is oriented substantially vertically, that is to say parallel to the illustrated Z direction. The attachment of the pan section 3 to the box section 2 is realized exclusively by first connecting means 8 which are arranged along the peripheral rim 5. A central region of the base 4 of the pan section 3 can thus vibrate relatively freely, similarly to a diaphragm.

Figure 3:
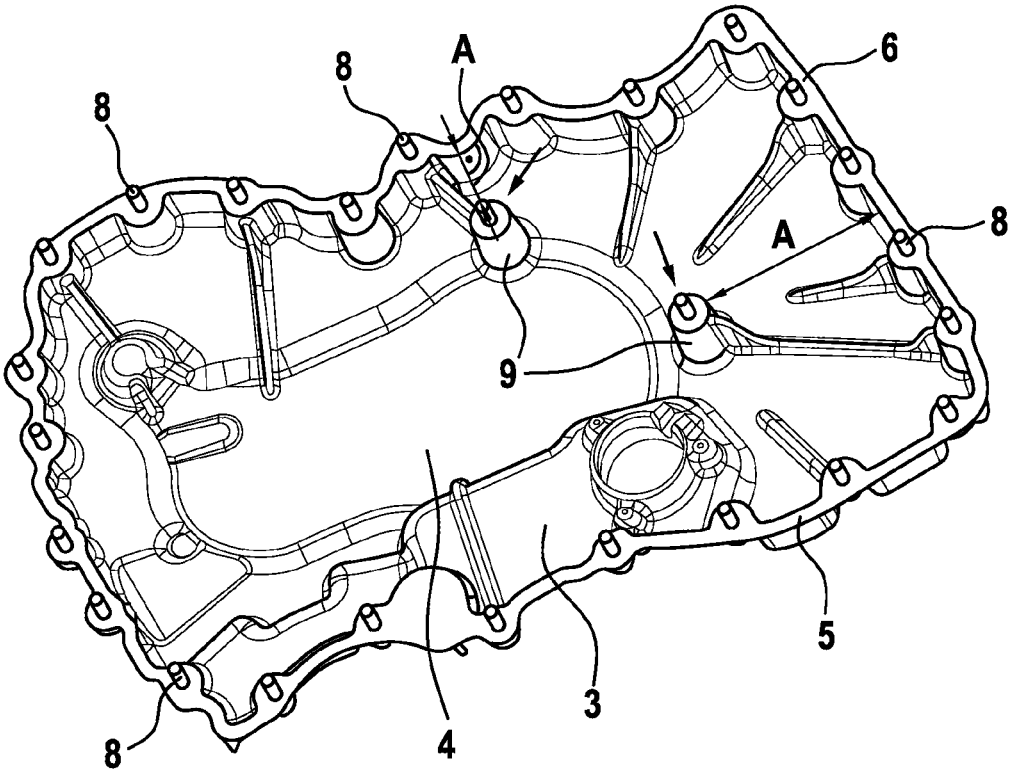
FIG. 3 is an oblique view from above of a pan section according to an embodiment of the invention.

FIG. 3 illustrates a pan section 3 for an oil pan according to an embodiment of the invention in an oblique view from above. The pan section 3 has an encircling (peripheral) rim 5 with a first sealing surface 6, with a multiplicity of first connecting means 8 being arranged along the rim 5. Additionally, the pan section 3 also has two second connecting means 9, which are each arranged with a spacing A to the rim 5. Here, the spacing A to the rim 5 is measured, as illustrated, in an orthogonal direction with respect to the inwardly directed surface of the rim 5. By means of the arrangement of the two second connecting means 9, the vibration characteristics of the base 4 (floor) can be positively influenced in that, in the installed state, the natural frequency of the base 4 is considerably increased by the additional second connecting means 9.

Figure 4:
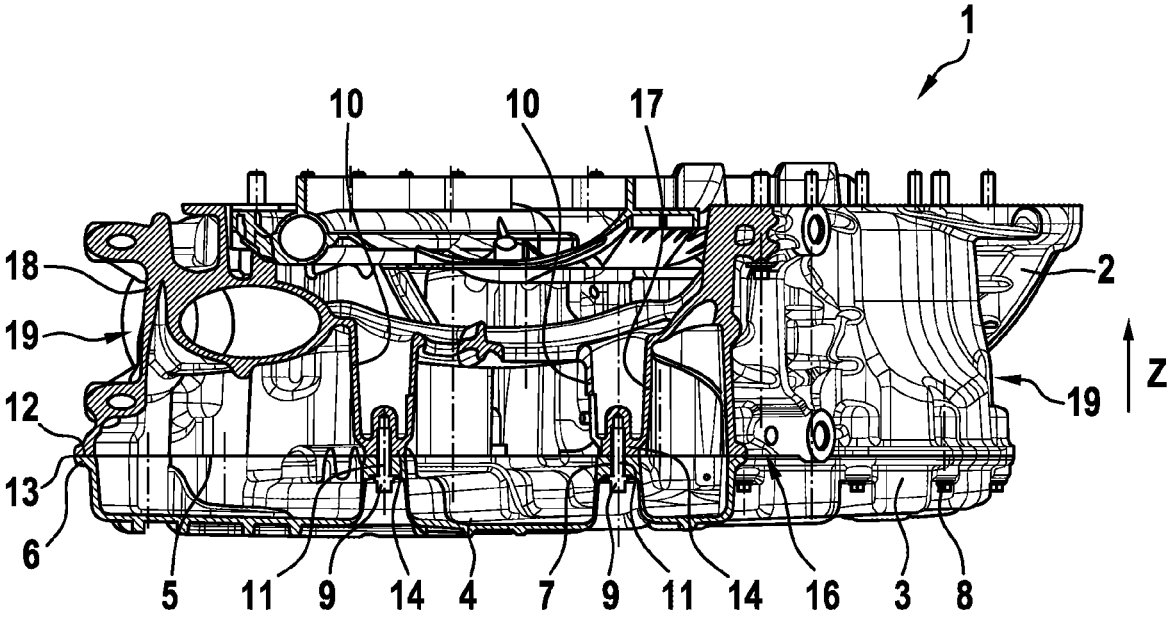
FIG. 4 is a vertical sectional view through a two-part oil pan according to an embodiment of the invention.

FIG. 4 shows a vertical sectional view through the oil pan 1 with the section passing through the two second connecting means 9. The oil pan 1 is formed by the box section 2 and the pan section 3, which are connected to one another by the first connecting means 8 and additionally by the second connecting means 9. It is possible to see the base 4 formed by the pan section 3, the rim 5 and the pan wall 18 formed by the box section 2. To form the second connecting means 9, the box section 2 has two screw bosses 10 into which screws 11 can be screwed through the bores 7. The second connecting means 9 or the screw bosses 10 are arranged on a transverse strut 17 which connects mutually spaced-apart regions 19 of the pan wall 18 to one another. The transverse strut 17 stiffens the oil pan 1. A first sealing means 13 (not illustrated in any more detail) which closes off the oil pan 1 in oil-tight fashion is arranged between the first sealing surface 6 of the pan section 3 and a second sealing surface 12 of the box section 2. Additionally, second sealing means 14 are provided at the second connecting means 9 in order to also close off these regions in oil-tight fashion to the outside.

Figure 5:
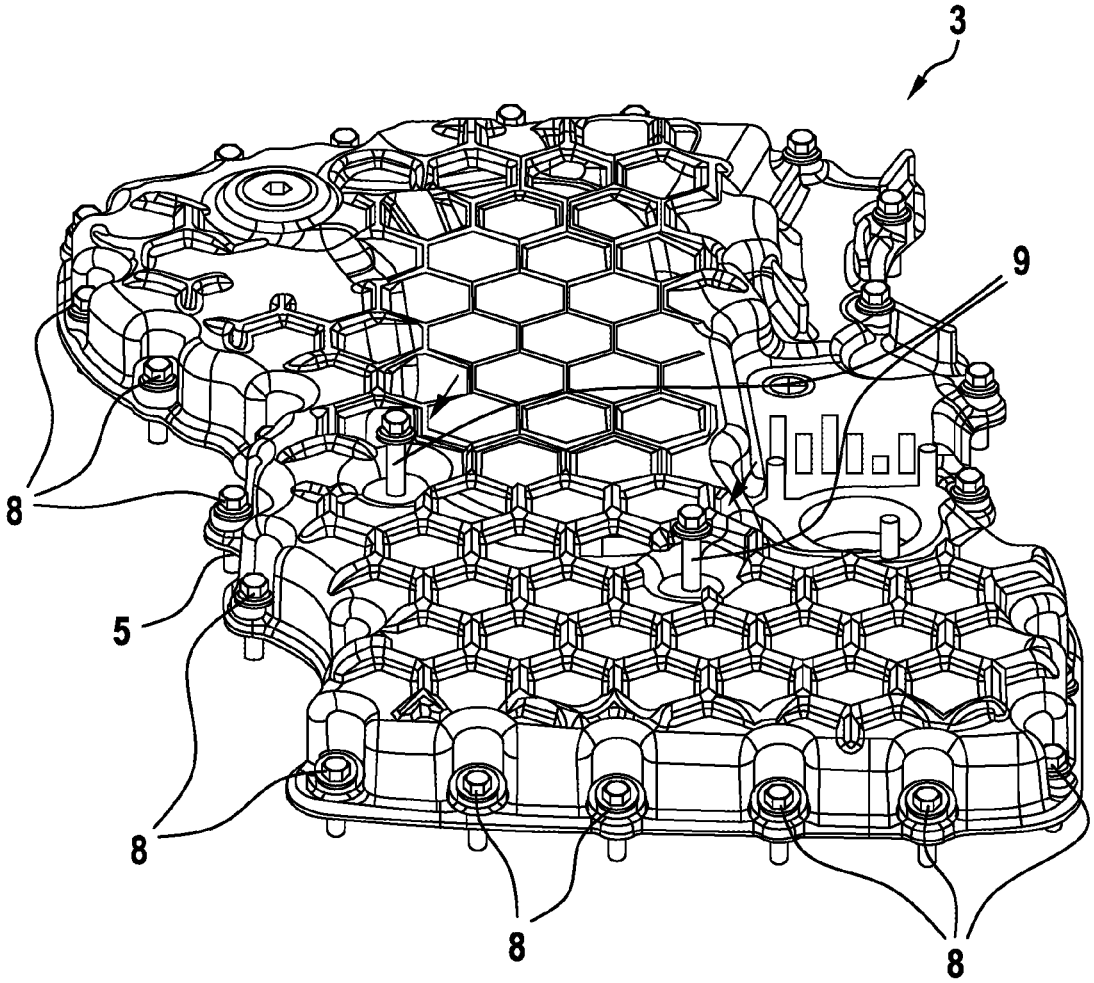
FIG. 5 is an oblique view from below of a pan section according to an embodiment of the invention.

FIG. 5 shows a pan section 3 in an oblique view from below, with the first connecting means 8 and the second connecting means 9 being visible. It is possible to clearly see here that the second connecting means 9 should be arranged so as to be spaced apart as far as possible (by the greatest possible distance) from the rim 5.

Figure 6:
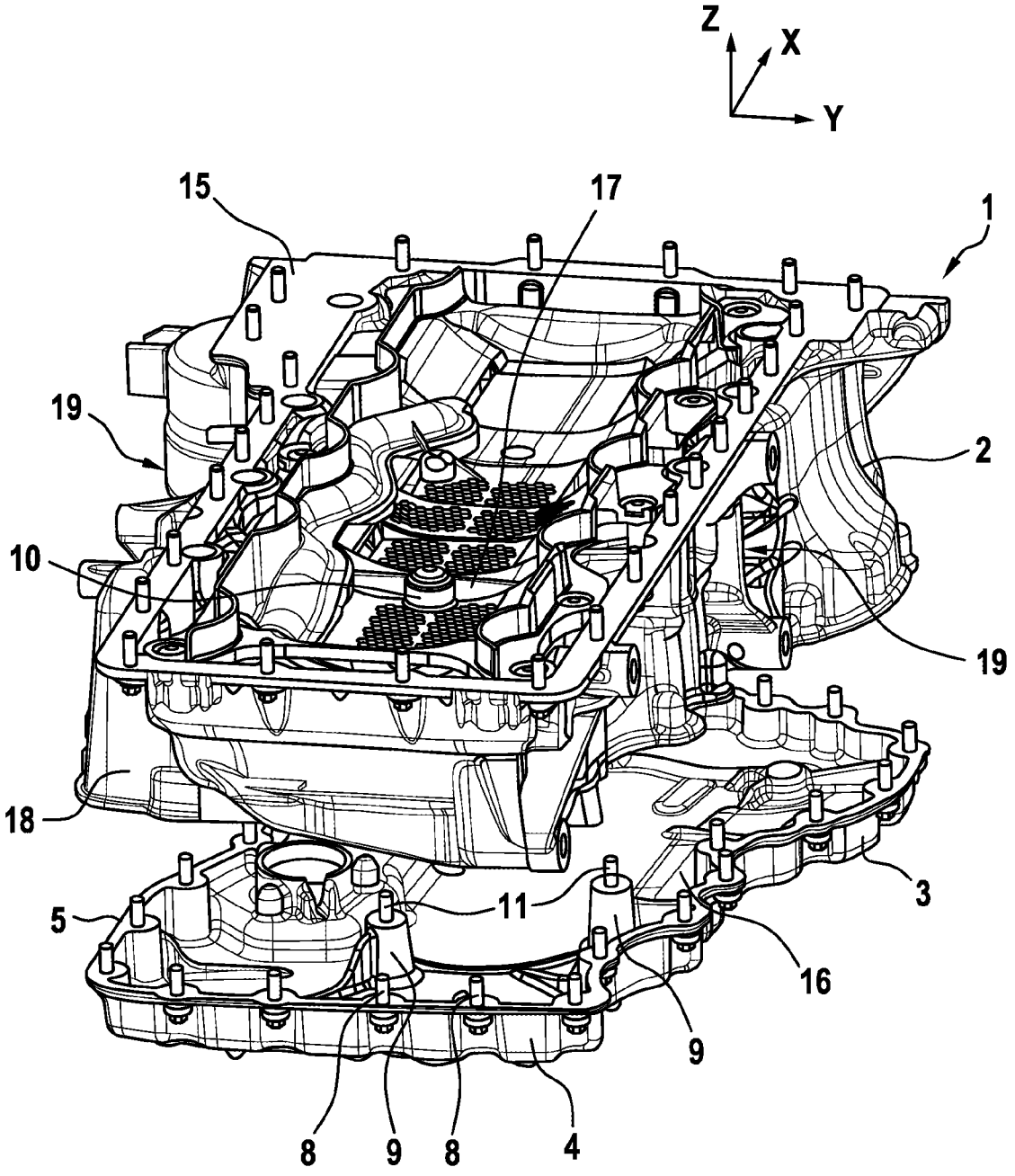
FIG. 6 is an exploded illustration of a two-part oil pan according to an embodiment of the invention.

FIG. 6 shows the oil pan 1 in an oblique view, wherein the box section 2 has been illustrated as having been separated from the pan section 3 in a vertical direction, that is to say in the Z direction. The pan section 3 forms the base 4 with the rim 5, and the box section 2 forms the pan wall 18 with the opening 16, which is closed off by the base 4 or by the pan section 3.

The box section 2 has a flange surface 15 on which a crankcase (not illustrated) of an internal combustion engine can be flange-mounted. It is also possible to clearly see one of the provided screw bosses 10 that are provided for receiving the screws 11 and for forming second connecting means 9. By means of the additional attachment of the pan section 3 to the box section 2 by the second connecting means 9, the acoustic characteristics of the oil pan 1 are positively influenced. Aside from the improvement in acoustics, the present invention also offers further advantages. For example, the oil pan 1 can be significantly stiffened by the additional second connecting means 9. The oil pan 1 thus deforms to a considerably lesser extent under load, and depending on the application can also be dimensioned to be smaller and thus more lightweight. Furthermore, a weight saving can be realized because fewer sound insulation measures are necessary on the vehicle. Furthermore, the number of first connecting means 8 required in the region of the rim 5 can be reduced, because a proportion of the forces is transmitted via the second connecting means 9.

Figure 7:
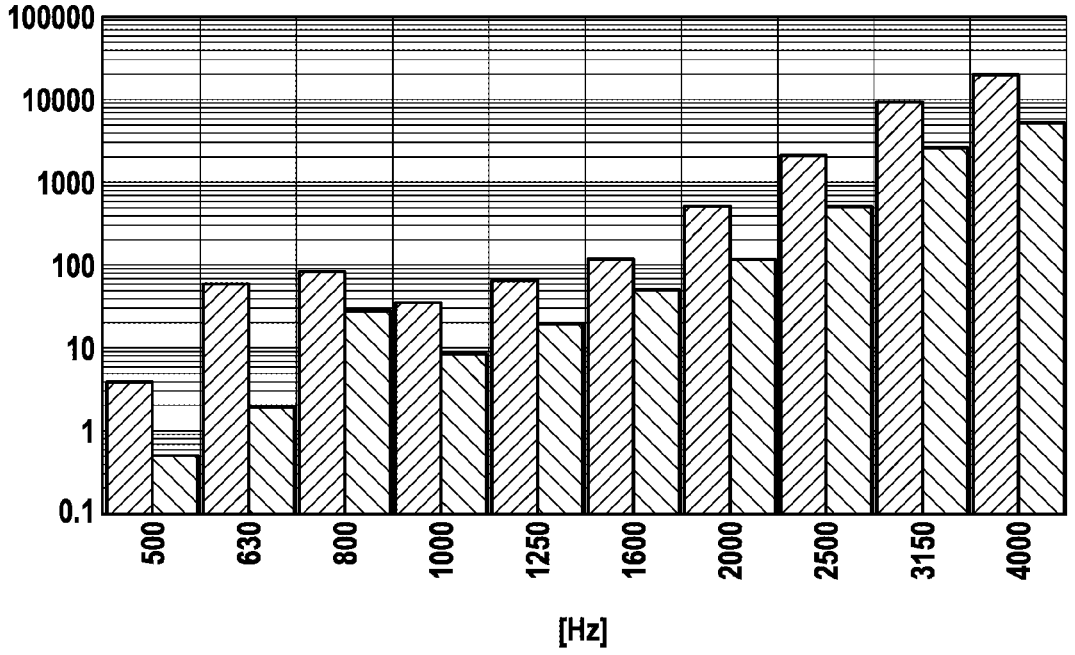
FIG. 7 is a graphical comparison of the measurement results according to the prior art and the present invention.

FIG. 7 finally shows, on the basis of a graph, the measured improvements in the acoustic characteristics imparted by the invention in relation to oil pans without second connecting means. Here, the respectively measured frequency in hertz is plotted on the horizontal axis, and the sound power in watts is plotted on the vertical axis. The vertical axis furthermore rises logarithmically. The bar plotted in each case on the left at each frequency shows the measured values of a pan section 3 designed according to the prior art. Adjacently to the right thereof are the respective measured values of a pan section 3 designed according to the present invention. It can be clearly seen here that the sound power levels of the pan section designed according to the invention with second connecting means are considerably lower than the sound power levels of a pan section designed according to the prior art.

LIST OF REFERENCE DESIGNATIONS

1) Oil pan
2) Box section
3) Pan section
4) Base (floor)
5) Rim (edge)
6) First sealing surface
7) Bores
8) First connecting means
9) Second connecting means
10) Screw boss
11) Screw
12) Second sealing surface
13) First sealing means
14) Second sealing means
15) Flange surface
16) Opening
17) Transverse strut
18) Pan wall
19) Spaced-apart regions
A) Spacing

What is claimed is:

1. A two-part oil pan for an internal combustion engine, comprising:

a box section; and a pan section, wherein the pan section forms a base of the oil pan and the box section forms a pan wall of the oil pan, the box section and the pan section are sealingly connected to one another by first connecting means at a peripheral rim with a peripheral first sealing surface on the pan section and a peripheral second sealing surface on the box section, the pan section and the box section are additionally connected to one another by at least one second connecting means which is arranged within the rim and at a spacing to said rim, the at least one second connecting means directly connecting a base of the pan section only to the box section, the box section has at least one transverse strut which connects two mutually spaced-apart regions of the pan wall to one another, and the pan section and the box section are connected to one another at the transverse strut by the second connecting means.

2. The oil pan according to claim 1, wherein first sealing means are provided on the peripheral sealing surfaces between the box section and the pan section.

3. The oil pan according to claim 2, wherein second sealing means for sealing off the base are provided at the second connecting means.

4. The oil pan according to claim 1, wherein the spacing between the second connecting means and the rim, measured in an orthogonal direction from an inner side of the rim, is at least 20 mm.

5. The oil pan according to claim 1, wherein the spacing between the second connecting means and the rim, measured in an orthogonal direction from an inner side of the rim, is at least 100 mm.

6. The oil pan according to claim 1, wherein the second connecting means is arranged within a radius R about a center of area of the base of the oil pan, wherein the radius R is selected to be less than 400 mm.

7. The oil pan according to claim 1, wherein the second connecting means is arranged within a radius R about a center of area of the base of the oil pan, wherein the radius R is selected to be less than 200 mm.

8. An internal combustion engine comprising an oil pan according to claim 1.

9. A motor vehicle comprising an internal combustion engine according to claim 8.

* * * * *